United States Patent [19]

Hargrave

[11] 4,370,694

[45] Jan. 25, 1983

[54] ELECTRICAL INTERLOCK

[75] Inventor: Thomas A. Hargrave, Richardson, Tex.

[73] Assignee: Rockwell International Corporation, El Segundo, Calif.

[21] Appl. No.: 193,874

[22] Filed: Oct. 3, 1980

[51] Int. Cl.[3] ..... H01R 13/44

[52] U.S. Cl. ..... 361/179; 455/117; 455/129; 200/51.09

[58] Field of Search ..... 361/170, 179; 340/568, 340/687; 455/117, 129; 200/51.09, 51.1; 343/894, 906

[56] References Cited

U.S. PATENT DOCUMENTS

| | | | |
|---|---|---|---|
| 749,633 | 1/1904 | Seeley . | |
| 3,182,260 | 5/1965 | Heaton-Armstrong | 455/117 |
| 3,192,518 | 6/1965 | Sliman . | |
| 3,782,256 | 1/1974 | Quinn | 200/51.09 |
| 4,002,397 | 1/1977 | Wang et al. | 340/568 |
| 4,044,208 | 8/1977 | McDonald et al. | 200/51.09 |
| 4,081,750 | 3/1978 | Herr et al. | 455/129 |
| 4,106,025 | 8/1978 | Katz | 455/129 |
| 4,127,855 | 11/1978 | Toner | 340/687 |
| 4,137,521 | 1/1979 | Martinez | 340/63 |
| 4,156,265 | 5/1979 | Rose | 361/179 |

*Primary Examiner*—J. D. Miller
*Assistant Examiner*—L. C. Schroeder
*Attorney, Agent, or Firm*—Richard K. Robinson; Howard R. Greenberg; H. Fredrick Hamann

[57] ABSTRACT

A radio transmitter is protected against the possibility of initiating transmission without the radio being connected to a load by having a switch that controls a push-to-talk key line that is only enabled when the antenna load is connected to the transmitter.

4 Claims, 6 Drawing Figures

ELECTRICAL INTERLOCK

BACKGROUND OF THE INVENTION

This invention relates to electrical interlock circuits for radio transmitters.

It is known in the art that an electrical connector whose primary function is to connect two pieces of electrical equipment together through the use of electrical conductors may also perform secondary functions such as providing shielding and electrical interlocks. An example of the multifunctional use of electrical connectors is provided in U.S. Pat. Nos. 749,633, 3,192,518, 3,782,256, 3,982,803, 4,127,855, 4,044,208 and 4,137,521.

SUMMARY OF THE INVENTION

Although the above referenced prior art disclosed many methods of providing secondary electrical connection functions utilizing a primary connector, the referenced embodiments require special and complicated circuit arrangements such as push button or plunger type switches and in many cases are completely unadaptable to commercially available connectors.

A radio transmitter is protected against the possibility of initiating transmission without the radio being connected to a load by having a switch that controls a push-to-talk key line that is only enabled with the antenna load is connected to the transmitter and may be implemented on previously built equipment with only minor (adding a relay to the push-to-talk key) modification of the equipment.

A flat washer insulator is placed over a male connector and has connected to it an electrical conductor mounted on one surface which is insulated from the male conductor. When the female connector is connected to the male connector, the outer edge of the female connector comes into electrical contact with the electrical conductor which is connected to a relay and will enable the push-to-talk key line contained within a radio transmitter. There are several embodiments illustrating the mounting techniques for the conductor to the insulating washer as well as the connection of the protection circuits to the conductor.

BRIEF DESCRIPTION OF THE DRAWINGS

The following detailed description will enable the invention to be more fully comprehended. A list of relevant figures accompanies the description in which.

DETAILED DESCRIPTION OF THE PREFERRED EMBODIMENT

Figure 1:
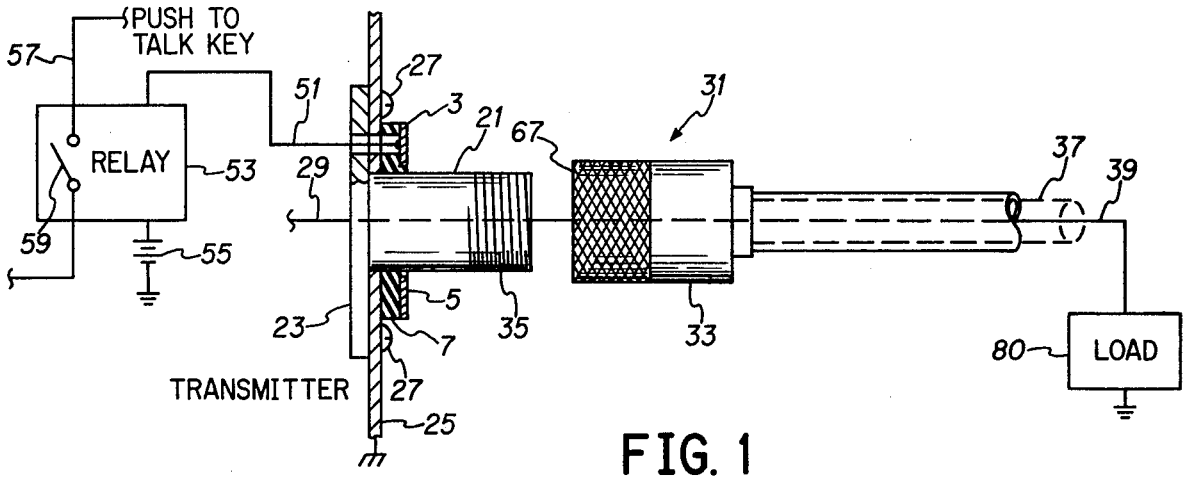
FIG. 1 is a combination drawing illustrating the protection circuit and radio transmitter according to the invention.
Figure 6:
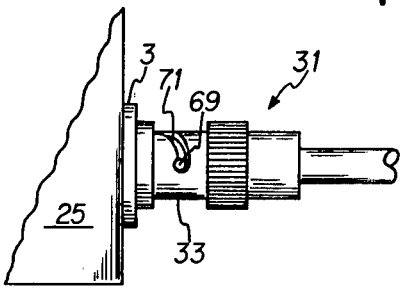
FIG. 6 is still another embodiment of the invention.

Referring to FIG. 1, there is shown a radio transmitter that has an output connector 21 with an outer shield such as a metal case 23 that is connected to the chassis of the transmitter 25 by means of fastener means 27 and the chassis is connected to ground or reference potential. Internal to the case of the connector 21 is a conductor 29 which is connected to the output of the radio transmitter. The connector 21 is a male type connector and in the preferred embodiment shown in FIG. 1 is an "N" or "TNC" type coaxial cable connector, or a "BNC" type shown in FIG. 6, that is commercially available in the art and is designed to accept a female type connector 31. The female type connector 31 has a metal barrel 33 and is fastened to the male connector by means of the threaded region 35, or bayonnett pins 69 as shown in FIG. 6, which is designed to match the threaded region or slots 71 of FIG. 6, located inside the metal barrel 33 of the connector 31. The connector 31 is connected to a transmission cable which in the case of the preferred embodiment is a coaxial conductor 39 that is separated from the shield 37 by an insulating medium. The conductor 39 is eventually connected to a load 80 such as an antenna and thus provides coupling from the output of the radio transmitter to the antenna.

In normal operation the output power from the power amplifier (not shown) located within the radio transmitter is not applied to the conductor 29 unless the push-to-talk key is energized by the operator at which occurrence, the power amplifier is energized and the output power is applied to the conductor 29. In the event that there is no load connected to the conductor 29 by way of the male connector 21 and the female connector 31, then when the push-to-talk key line is energized, the radio will be driving its output power which may be on the order of kilowatts or even megawatts into a load that approaches infinity versus the standard load of an antenna which is normal cases is approximately 50 ohms. This occurrence is not only detrimental to the radio transmitter but in many cases can be fatal to the radio operator. Therefore, to prevent the push-to-talk key from being energized, there is shown in FIG. 1 an electrical interlock that includes an insulating spacer 3 having a conductor affixed to it which is joined to an electrical conductor 51 and a normally open relay 53 that is connected to a power source 55. As long as the female connector 31 is not connected to the male connector 21, then the relay 53 is deenergized and, thus, there is an open circuit in the push-to-talk key line 57 which is connected to the normally open contacts 59 of the relay 53. When the female connector 31 is properly secured to the male connector 21 (as shown in FIG. 6), then the metal barrel 33 is in good electrical contact with the metal case 23 of the male connector 21. The edge 67 of the female conductor 31 compresses the spacer 3 causing electrical contact to be made between the conductor 5 and the edge 67 of the female connector 31. The female connector 31 is thus connected to the chassis 25 by way of the male connector 21 and the metal case 23 which is held in place against the chassis 25 by means of the fastener means 27. There is then a closed circuit that includes a power supply 55, the relay 53 and the conductor 51 which causes the contact 59 to close, thus, returning the push-to-talk key to the operator control.

Figure 2:
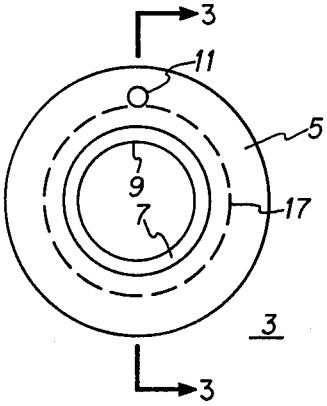
FIG. 2 is a drawing of the insulating spacer according to the invention.

FIG. 2 is a drawing illustrating the spacer 3 that has an opening 9 through its center and a conductor 5 mounted on to it that is insulated from the center opening by the insulating material 7 which may be any type of insulating material but in the preferred embodiment is made from a closed-cell sponge material. There is a connection point 11 which can be a screw type receptical for joining the wire 51 or feedthrough hole which will facilitate the soldering of a wire or other means of fastening the wire to conductor 5. The dotted ring 17 indicates the contact area for the edge 67 of the female connector 31 and insures by the location thereof that the edge 67 is in contact with the conductor 5.

Figure 3:
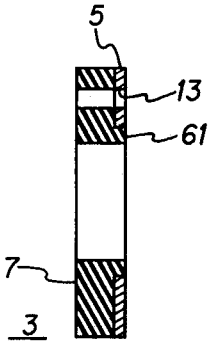
FIG. 3 is a sectional view of FIG. 2.

FIG. 3 which is a sectional view of FIG. 2 illustrates the fabrication of the spacer 3 and provides for the mounting of the conductor 5 by depositing a conductor on the insulating material 17. Alternatively, a washer may be secured to the insulating material by the lips 61 machined on to the insulating material 7 such that the conductor 5, which is a washer made of a material such as tinplated copper, is forced onto the insulating material 7 and held in place by the lips 61.

Figure 4:
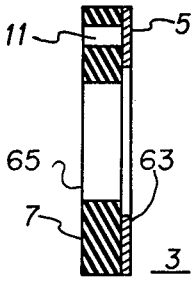
FIG. 4 is an alternate embodiment of the sectional view of FIG. 2 according to the invention.

An alternate embodiment is provided in FIG. 4 in which the conductor 5 has a washer shape with the center opening 63 being greater than the clearance hole 65 that is used to clear the male connector 21 and is bonded to the insulating material 7. The conductor 5 may be joined to the washer in this embodiment by butt welding.

Figure 5:
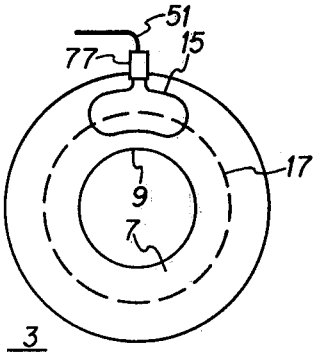
FIG. 5 is another embodiment of the insulating spacer according to the invention.

An alternate embodiment is illustrated in FIG. 5 in which the conductor 5 is merely a tab 15 that is affixed to the insulating material 7 and provides a connector on one end 77 for connecting the conductor 51 thereto. The prime consideration for the embodiments illustrated in FIGS. 2, 3, 4, 5 and 6 is that the edge 67 be in electrical contact with the conductor 5.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

I claim:

1. An electrical interlock comprising:

protection circuit means for protecting electrical equipment;

a male type connector with an external conductor shaped to provide a first fastener means;

a flat insulated spacer means for mounting on the male type connector the flat insulated spacer mean includes; an electrical insulator shaped as a washer with a first center opening—an electrical conductor shaped as a washer with a second center opening having a greater diameter than the first center opening—mounting means for mounting the electrical conductor on the insulator—and connector means for connecting the electrical conductor to the protection circuit means to provide an electrical contact thereby;

a female type connector with an external conductor shaped to provide a second fastener means acceptable to the first fastener means; and the protection circuit means being connected to the electrical conductor whereby when said first fastener means is engaged with the second fastener means, the protection circuit is deactivated to enable the use of the electrical equipment.

2. The electrical interlock circuit according to claim 1 wherein the protection circuit means comprises:

a relay with at least one set of normally open contacts;

a power supply connected between one side of the coil of the relay and a reference potential;

conductor connected between the other side of the relay and the electrical contact;

means for mounting the male type connector to the electrical equipment;

means for energizing the electrical equipment; and means for connecting the electrical conductor in series with the means for energizing the electrical equipment.

3. In a combination a radio transmitter having an electrical interlock circuit comprising:

a protection circuit;

a male type connector with an external conductor shaped to provide a first fastener means connected to the output of the radio transmitter;

a flat insulated spacer means mounted on the male type connector; the flat insulated spacer means includes; an electrical insulator shaped as a washer with a first center opening—an electrical conductor shaped as a washer with a second center opening having a greater diameter than the first center opening—mounting means for mounting the electrical conductor on the insulator—and connector means for connecting the electrical conductor to the protection circuit to provide an electrical contact thereby;

a female type connector with an external conductor shaped to provide a second fastener means accepted to the first fastener means and connected to the load of the radio transmitter; and the protection circuit means being connected to the electrical conductor on the flat insulator means whereby when said first fastener means is engaged with the second fastener means, the protection circuit is disabled thereby enabling the use of the radio transmitter.

4. The combination according to claim 3 wherein the protection circuit comprises:

a relay with at least one set of normally open contacts;

a power supply connected between one side of the coil of the relay and a reference potential;

conductor connected between the other side of the relay and the electrical conductor;

means for mounting the male type connector to the electrical equipment;

means for energizing the electrical equipment; and means for connecting the electrical contact in series with the means for energizing the electrical equipment.

* * * * *